US009771766B2

(12) United States Patent
Williams

(10) Patent No.: US 9,771,766 B2
(45) **Date of Patent: *Sep. 26, 2017**

(54) RELEASE TOOL WITH ADJUSTABLE RELEASE ROD FOR A DRILL STRING INSIDE BLOWOUT PREVENTER

(71) Applicant: DWJ INC., Lafayette, LA (US)

(72) Inventor: Donald L. Williams, Lafayette, LA (US)

(73) Assignee: DWJ Inc., Lafayette, LA (US)

( * ) Notice: Subject to any disclaimer, the term of this patent is extended or adjusted under 35 U.S.C. 154(b) by 10 days.

This patent is subject to a terminal disclaimer.

(21) Appl. No.: 15/050,185

(22) Filed: Feb. 22, 2016

(65) Prior Publication Data

US 2016/0258233 A1 Sep. 8, 2016

Related U.S. Application Data

(60) Provisional application No. 62/127,504, filed on Mar. 3, 2015.

(51) Int. Cl.
*E21B 21/10* (2006.01)

(52) U.S. Cl.
CPC ..... *E21B 21/106* (2013.01)

(58) Field of Classification Search
CPC ..... F16L 57/005; F16L 1/00; B65D 59/00
See application file for complete search history.

(56) References Cited

U.S. PATENT DOCUMENTS 1,635,749 A 7/1927 Hosmer
1,754,692 A 4/1930 Miller
2,139,983 A 12/1938 Stone
2,213,309 A 9/1940 Fortune
2,624,610 A 1/1953 Murphy
2,647,728 A 8/1953 Smith
(Continued)

OTHER PUBLICATIONS

ABS; Mobile Offshore Drilling Units—Classification, Certification & Related Services; at least as early as Apr. 2014; ABS, Houston, TX; US.

(Continued)

*Primary Examiner* — Matthew R Buck
*Assistant Examiner* — Aaron Lembo
(74) *Attorney, Agent, or Firm* — Jeffrey L. Wendt; The Wendt Firm, P.C.

(57) ABSTRACT

Inside blowout preventer release tool having an upper section and a tubular lower section. The upper section includes a pair of longitudinal members defining a central open region, and a formed lifting feature accepting a manipulator. The lifting feature is positioned such that when the release tool body and an inside blowout preventer connected thereto are lifted by the rig hoist they are easily moved over, aligned with, and connected with a working drillpipe while minimizing possibility of slipping off cables or chains. The lower section includes a threaded end mating with a mating end of an inside blowout preventer, a central longitudinal bore to accept a length-adjustable release rod, and an upper end formed to mate with the upper section. Slots in each longitudinal member may define one or more manipulating handles for a rig worker, machine, or tool, or a pair of generally horizontal hand holds are provided.

20 Claims, 7 Drawing Sheets

(56) References Cited

U.S. PATENT DOCUMENTS

| | | | |
|---|---|---|---|
| 2,752,119 | A | 6/1956 | Allen et al. |
| 2,894,715 | A | 7/1959 | Bostock |
| 3,035,808 | A | 5/1962 | Knox |
| 3,066,590 | A | 12/1962 | Böhm |
| RE25,471 | E | 11/1963 | Fredd |
| 3,126,908 | A | 3/1964 | Dickens |
| 3,667,505 | A | 6/1972 | Radig |
| 3,667,557 | A | 6/1972 | Todd et al. |
| 3,783,942 | A | 1/1974 | Mott |
| 3,835,925 | A | 9/1974 | Mott |
| 3,850,191 | A | 11/1974 | Brown |
| 3,850,194 | A | 11/1974 | Brown |
| 3,861,470 | A | 1/1975 | Mott |
| 3,941,348 | A | 3/1976 | Mott |
| 4,040,441 | A | 8/1977 | Brown et al. |
| 4,049,015 | A | 9/1977 | Brown et al. |
| 4,074,761 | A | 2/1978 | Mott |
| 4,088,298 | A | 5/1978 | Brown et al. |
| 4,108,203 | A | 8/1978 | Brown |
| 4,125,164 | A | 11/1978 | Terry |
| 4,263,936 | A | 4/1981 | Brown |
| 4,291,762 | A | 9/1981 | Gudgel |
| 4,294,314 | A | 10/1981 | Miyagishima et al. |
| 4,403,628 | A | 9/1983 | Nijjar |
| 4,417,600 | A | 11/1983 | Kohn |
| 4,467,823 | A | 8/1984 | Shaffer et al. |
| 4,478,279 | A | 10/1984 | Puntar et al. |
| 4,480,813 | A | 11/1984 | Holley |
| 4,523,608 | A | 6/1985 | Miller |
| 4,650,153 | A | 3/1987 | Winegeart |
| 4,681,133 | A | 7/1987 | Weston |
| 4,694,855 | A | 9/1987 | Cunningham |
| 4,795,128 | A | 1/1989 | Krasnov et al. |
| 5,246,203 | A | 9/1993 | McKnight et al. |
| 5,507,467 | A | 4/1996 | Mott |
| 5,529,285 | A | 6/1996 | McKnight et al. |
| 6,158,505 | A | 12/2000 | Araujo |
| 6,712,147 | B2 | 3/2004 | Dallas |
| 7,108,081 | B2 | 9/2006 | Boyadjieff |
| 7,137,453 | B2 | 11/2006 | Gustafson et al. |
| 7,308,954 | B2 | 12/2007 | Martin-Marshall |
| 7,950,668 | B2 | 5/2011 | Gustafson et al. |
| 8,230,931 | B2 | 7/2012 | Rodriguez et al. |
| 8,443,876 | B1 | 5/2013 | Keast |
| 8,443,877 | B1 | 5/2013 | Keast |
| 9,404,321 | B2 * | 8/2016 | Williams ..... E21B 19/02 |
| 9,404,341 | B2 * | 8/2016 | Williams ..... E21B 34/08 |
| 2013/0043044 | A1 | 2/2013 | Garber et al. |
| 2015/0068768 | A1 | 3/2015 | Williams |
| 2015/0308200 | A1 * | 10/2015 | Williams ..... E21B 19/02 166/380 |
| 2016/0258233 | A1 * | 9/2016 | Williams ..... E21B 21/106 |
| 2016/0326815 | A1 * | 11/2016 | Williams ..... E21B 19/02 |

OTHER PUBLICATIONS

Shilling et al., Development of Fatigue Resistant Heavy Wall Riser Connectors for Deepwater HPHT Dry Tree Riser Systems, Proceedings of the ASME 28th International Conference on Ocean, Offshore and Arctic Engineering; May 31-Jun. 5, 2009; ASME; New York, NY; US.

M & M Internatonal; Ball Valves Product Information Sheet; at least as early as Apr. 2014; M & M International; Broussard, LA; US.

McMaster-Carr; Quick-Release One-Piece Clamp-on Shaft Collar product information sheet; Sep. 10, 2013; McMaster-Carr, Atlanta, GA; US.

McMaster-Carr; Steel Round Knurled-Rim Knob product information sheet; Sep. 10, 2013; McMaster-Carr, Atlanta, GA; US.

Moffat 2000 Limited; Moffat Subsea Stab Connector™; no month, 2010; Moffat (2000) Ltd; Northumberland, UK.

TIW Corporation; Pressure Control Systems; Safety & Kelly Valve Systems; at least as early as Apr. 2014; TIW Corporation; A Pearce Industries Company; Houston, TX; US.

WNCO Valve International; Inside B.O.P. Dart Valves; no month, 2013; WNCO Valve International, Odessa, TX; US.

United Staes Patent and Trademark Office; Non-Final Office Action issued for 14/464,663 dated Mar. 21, 2016; 18 pages; Alexandria, VA.

United Staes Patent and Trademark Office; Non-Final Office Action issued for 14/667,543 dated Mar. 28, 2016; 109 pages; Alexandria, VA.

* cited by examiner

RELEASE TOOL WITH ADJUSTABLE RELEASE ROD FOR A DRILL STRING INSIDE BLOWOUT PREVENTER

BACKGROUND INFORMATION

Technical Field

The present disclosure relates to apparatus and methods in the onshore and marine (offshore) hydrocarbon exploration, production, drilling, well completion, well intervention, and leak containment fields. More particularly, the present disclosure relates to release tools for inside blowout preventers.

Background Art

A "blowout (or blow out) preventer", commonly known as a "BOP", is a valve that may be used to prevent a well, usually a hydrocarbon producing well, from flowing uncontrollably. An "inside BOP" (also sometimes referred to as an "internal BOP", "IBOP", "kelly valve", or "kelly cock") is a BOP inside a drillpipe or drillstring, usually used to prevent the well from flowing uncontrollably up the drillstring. Industry standards require having an IBOP for every string of pipe in the hole on every rig that is working.

Currently, IBOPs, which may weight 300 pounds or more, have no lifting eyes on their cap (also referred to as a "release tool") or otherwise, although separate lifting devices that attach to the drillpipe and/or IBOP may have one or more lifting eyes, as taught in U.S. Pat. No. 4,291,762. They have been this way for many years. FIG. 1 is a side elevation view, partially in cross-section, of a non-limiting representative example of such an IBOP. There are many types of IBOP, and the present disclosure is relevant to all. U.S. Pat. Nos. 2,647,728; 4,403,628; 4,694,855; 4,294,314; 4,478,279; 5,507,467; 8,443,876; 8,443,877; 3,667,557; 3,835,925; 3,861,470; 4,291,762; 7,137,453; 7,950,668, and 7,108,081; and U.S. Published patent application no. 2013/0043044A1 all describe various types of IBOPs and/or accessories for same, such as actuators for IBOPs. Other examples of IBOPs may presently be found on the Internet websites of Global Manufacturing and M&M Industries. All of these patents and published patent applications are incorporated herein by reference.

In current practice in the field, the drilling rig workers tie a chain, cable, or strap around the IBOP valve cap to pick up the cap and the IBOP valve to which it is attached using a rig hoist and stab it into the drillpipe. The valve must be open (as shown in FIG. 1) in order to screw it into the drill pipe. If closed the pressure will blow it out before the threads can be started. The drilling rig workers turn the valve clockwise by hand to screw it into the drillpipe. In some instances, rig workers grab side handles (round rods welded to the release tool, as depicted in FIG. 1) and turn it with the round rods. Then they loosen the lock screw to release the rod holding the valve open. Then they tighten the threads with the rig tongs and the well is secure. Mud or other drilling fluid may then be pumped through the valve down hole but no pressurized fluids may come out of the drillpipe. One of the above patents, U.S. Pat. No. 4,403,628, implies in Col. 3 of the patent that assembling an IBOP into a drill stem and removing the IBOP therefrom as just described, including lifting and manipulating the IBOP, is conveniently performed, but this is contrary to experience, as accidents can and have occurred. Rig personnel safety is of utmost concern. The inventor herein personally knows of several accidents where the old style cap/release tool and IBOP valve slipped off the chain, cable, or strap, dropping the IBOP. While the "iron" (slang term for rig tools) is used to being dropped and banged around the rig, the rig workers have the difficult tasks of not only using the rig hoist to pick up the IBOP/release tool, using chains or otherwise, but picking it up straight (vertical or substantially vertical) to align with and screw onto the working drillpipe, which more often than not has fluids and possibly solids escaping out at a high rate. Experience shows that when rig workers are required to make a loop with a chain, cable, rope, or strap around the whole valve (for example around two handles 21) it rarely if ever picks up straight; it is then necessary to attempt to get it straight to get threads 20 on the lower end started in the drillpipe threads. In the meantime, the valve or other rig components may shift position and the valve slips off the chain, with potential to injure rig workers, and without stopping flow from the drillpipe. Complications only increase on offshore rigs, whether working subsea or "dry" at the surface on the rig.

As may be seen, current practice of installing and removing IBOPs may not be adequate for all circumstances. There remains a need for more robust IBOP release tool designs, particularly for apparatus and methods allowing safe and quick connection/disconnection and ease of alignment, without extra tools, lifting frames, or effort. The apparatus and methods of the present disclosure are directed to these needs.

SUMMARY

In accordance with the present disclosure, improved release tools for IBOPs and methods of assembling the release tools and IBOPs and using same are described which reduce or overcome many of the faults of previously known tools and methods.

A first aspect of the disclosure is a modular release tool for use with inside blowout preventers comprising:

a release tool body comprising:

a one-piece, formed (defined herein as including milled, machined, molded, cast, machined or milled billet, but not welded or brazed), planar metallic upper section having a longitudinal axis, the upper section comprising a pair of longitudinal members defining a central open region, each longitudinal member having a lower end, the longitudinal members joined by a top manipulating end having one or more lifting features formed therein configured to accept one or more manipulators (cables, chains, straps, ropes), the one or more formed lifting features positioned such that when the release tool body and an inside blowout preventer connected thereto are lifted by the one or more manipulators, they are easily moved over, aligned with, and connected with a working drillpipe while minimizing possibility of slipping off the cables or chains;

a one-piece, formed, tubular metallic lower section removably attached to the upper section having the same longitudinal axis as the upper section, the lower section comprising a threaded (preferably externally tapered pin) end configured to threadedly mate with an end (preferably a box end) of an inside blowout preventer;

a central longitudinal bore configured to slidingly accept a release rod;

an upper end formed to accept the lower ends of the longitudinal members of the upper section and retaining members therefore;

the upper end further formed to comprise a central axial extension comprising one or more fluid outlets fluidly connected with the central longitudinal bore, the central axial extension of length sufficient to accommodate an internally threaded bore substantially perpendicular to and intersecting the central longitudinal bore, and configured to accept a mating threaded release rod lock screw therein; and a length-adjustable release rod slidingly positioned in the lower section central bore and dimensioned so as to be accessible by a rig worker or remotely operated device through the central region of the upper section, the central region having a width substantially larger than diameter of the release rod.

In certain embodiments, the one or more lifting features may be a single centered lifting eye formed through the top (manipulating) end of the upper section. Certain embodiments may comprise one or more formed slots in each longitudinal member of size sufficient to define one or more manipulating handles for a rig worker or mechanical manipulator to grasp the upper section and rotate the release tool and thread the pin end of the lower section into the box end of the inside blowout preventer. In certain embodiments the upper end of the lower section may be formed to include a pair of vertical receptacles for the lower ends of the upper section, wherein the retaining members may comprise one or more screws, bolts, pins, and the like threaded (or otherwise positioned and secured) through corresponding threaded (or other) bores through the receptacles and lower ends. In certain embodiments the length-adjustable release rod comprises an upper and a lower rod portion telescopically engaged and held in length position by one or more fasteners, such as cotter pins, screws, nuts and bolts, and the like. Certain embodiments may include a rod lock housing including one or more view slots allowing viewing of position of the release rod in the housing.

Another aspect of the disclosure is a combination modular release tool and inside blowout preventer for threadedly attaching to a drillpipe, the drillpipe having a threaded end (preferably an enlarged external diameter internally threaded upset end) for engaging the inside blowout preventer, the combination comprising an inside blowout preventer having a lower end threadably engageable with the drillpipe threaded end and an upper box end threadably engaged with a modular release tool of the present disclosure.

In addition to the features already mentioned, modular release tools and combinations of release tool/IBOP may further comprising a combination of metallurgy and structural reinforcement such as to prevent failure of the inside blowout preventer and/or release tool upon exposure to inner pressure up to 10,000 psia, or up to 15,000 psia, or up to 20,000 psia, or up to 25,000 psia, or up to 30,000 psia or higher, such as may be experience during onshore or offshore subsea drilling operations. Especially for offshore subsea applications, certain embodiments may further comprise one or more of the following features: one or more subsea hot stab ports for subsea ROV (remotely operated vehicle) intervention and/or maintenance of the inside blowout preventer and/or release tool; one or more ports allowing pressure and/or temperature monitoring inside the inside blowout preventer and/or release tool; one or more subsea umbilicals fluidly connected to one or more locations on the IBOP selected from the group consisting of a kill line, a choke line, and both kill and choke lines, optionally wherein one of the umbilicals is fluidly connected to a subsea manifold.

Another aspect of the disclosure is a method of easily and safely attaching a combination inside blowout preventer and modular release tool having a lower threaded end to a threaded end of a working drillpipe, the method comprising the steps of:

(a) optionally, determining whether lower section will make up to the IBOP, which depends on whether the IBOP will make up to the working drillpipe, and if not, changing the lower section of the release tool body (FIG. 2) to match size (outside diameter) of another IBOP;

(b) measuring the length of adjustable length release rod required by inspecting the IBOP (actual IBOP or drawing of same), setting the length of the release rod accordingly, and tightening the release rod lock screw;

(c) assembling the combination of IBOP and release tool so that the lower end of the locked-in-place, adjustable length release rod presses down on and moves into a position holding a valve of the IBOP open;

(d) lifting the combination, with IBOP valve locked open, to a position over the working drillpipe threaded end using the one or more formed lifting features on the release tool, the lifting feature positioned such that when the release tool body and IBOP attached thereto are lifted by the ropes, cables or chains, they are easily moved over, aligned with, and connected with the working drillpipe while minimizing possibility of slipping off the cables or chains;

(e) threading the combination onto the working drillpipe and continue turning the combination using formed handles so that threads of the lower end of the IBOP thread into the threads of the working drillpipe; and (f) optionally, if the IBOP is of the type having a check valve therein, as soon as the IBOP is fixed in position on the working drillpipe, no further escape of fluid or liquids will occur, and if the IBOP is the type having a valve therein, then the valve may be closed by turning the release rock lock screw, allowing an IBOP spring to bias and IBOP dart upward and seal, terminating flow.

An important feature of the apparatus and methods disclosed herein is the modularity, that is, the lower and upper sections of the release tool body may quickly and easily be disassembled, and the same upper section joined and used with another lower section of same or different outside diameter, such as if a one section cracks or otherwise becomes unusable. Another important feature of the apparatus and methods disclosed herein is the length-adjustment feature of the release rod, allowing a single release rod to be used with multiple IBOPs. In certain embodiments the lower section may be changed to accommodate a different diameter working drillpipe, although that may rarely occur. In certain embodiments, the method comprises changing the lower section of the release tool body to match size (outside diameter) of another inside blowout preventer prior to attaching the release tool to the other inside blowout preventer.

These and other features of the apparatus and methods of the disclosure will become more apparent upon review of the brief description of the drawings, the detailed description, and the claims that follow. It should be understood that wherever the term "comprising" is used herein, other embodiments where the term "comprising" is substituted with "consisting essentially of" are explicitly disclosed herein. It should be further understood that wherever the term "comprising" is used herein, other embodiments where the term "comprising" is substituted with "consisting of" are explicitly disclosed herein. Moreover, the use of negative limitations is specifically contemplated; for example, certain modular tool body systems, modular tools, combination modular tool and rig tool for threadedly attaching the rig tool to a drillpipe or to another component, and methods may comprise a number of physical components and features, but may be devoid of certain optional hardware and/or other features.

BRIEF DESCRIPTION OF THE DRAWINGS

The manner in which the objectives of this disclosure and other desirable characteristics can be obtained is explained in the following description and attached drawings in which:

It is to be noted, however, that the appended drawings of FIGS. 1-7 may not be to scale, and illustrate only typical apparatus embodiments of this disclosure. Furthermore, FIG. 8 illustrates only one of many possible methods of this disclosure. Therefore, the drawing figures are not to be considered limiting in scope, for the disclosure may admit to other equally effective embodiments.

DETAILED DESCRIPTION

Figure 1:
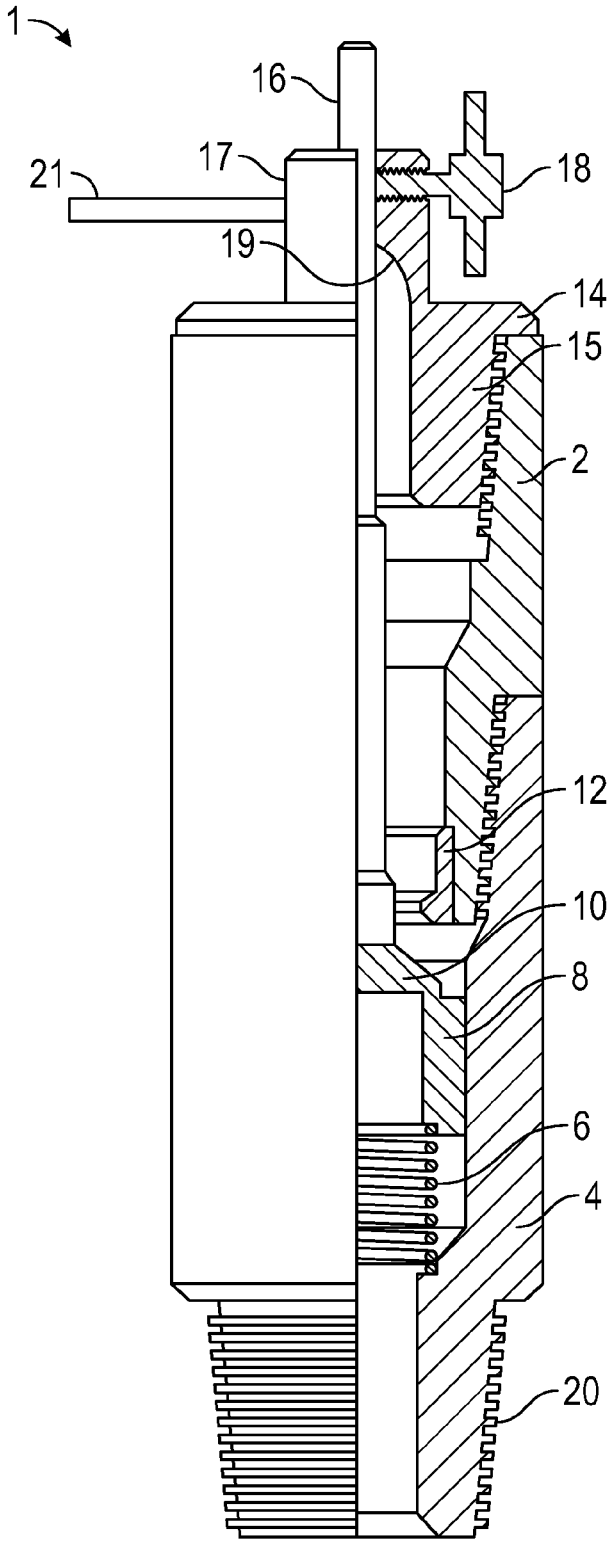
FIG. 1 (Prior Art)
FIG. 1 is a schematic side elevation view, partly in cross-section, of a prior art combination inside blowout preventer and release tool.

In the following description, numerous details are set forth to provide an understanding of the disclosed apparatus, combinations, and methods. However, it will be understood by those skilled in the art that the apparatus, combinations, and methods disclosed herein may be practiced without these details and that numerous variations or modifications from the described embodiments may be possible. All U.S. published patent applications and U.S. patents referenced herein are hereby explicitly incorporated herein by reference, irrespective of the page, paragraph, or section in which they are referenced.

The primary features of the apparatus, combinations, and methods of the present disclosure will now be described with reference to the drawing figures, after which some of the construction and operational details, some of which are optional, will be further explained. The same reference numerals are used throughout to denote the same items in the figures.

One aspect the present disclosure is a replacement for a release tool 14 (FIG. 1) that is already on at least 1000 drilling rigs in operation today. The primary focus was to replace the old release tools 14 with a new design (one embodiment 100 of which is illustrated in schematic perspective view in FIG. 2) so rig workers or rig tools operated by rig workers could place chain or other lifting attachment through a lifting eye, and also provide hand slots to "make it up" (slang term for attaching two oilfield components, here the new release tool to an IBOP), and use the same release tool with many IBOPs of same nominal size but having different lengths.

Prior to explaining features of the new release tool and other inventive aspects, reference should be made to FIG. 1, which is a schematic side elevation view, partly in cross-section, of a prior art combination 1 of an inside blowout preventer and release tool 14 known under the trade designation "WN-2 Inside BOP Dart Valve", available from WNCO Valve International, Odessa, Tex. (USA). The inside blowout preventer ("IBOP") includes an upper sub 2 and a lower sub 4 joined using tapered threads as illustrated. One-piece IBOP bodies are also known, and the release tools of the present disclosure are applicable to either variety of IBOP body. The IBOP may include a spring 6 biased to push up a dart 8 into mating relationship with a dart "O" ring 10 and dart seat 12. Other types of IBOP may feature a check valve (flap valve), and the release tools of the present disclosure are suitable for use with any type of IBOP. Lower sub 4 includes a lower threaded end 20 (either pin or box, usually a pin end as illustrated) to threadably mate with a working drillpipe (either box or pin end, usually a box end). The drillpipe is not illustrated.

Still referring to FIG. 1, prior art release tool 14 includes a lower body 15 that mates with upper sub 2. Usually, lower body 15 includes external tapered threads and upper sub 2 includes mating internal tapered threads, as illustrated, but other arrangements are possible. Prior art release tool 14 further includes a release rod 16 that extends through a bore of an axial extension 17, and a rod lock screw 18, the operation of which are very familiar to those of ordinary skill and require no further explanation. Some axial extensions include an open or closed archway such as 19, and some suppliers may provide one or more lateral "grab handles" 21 welded to the axial extension if asked for by rig workers or rig owners (or rig workers/owners may weld them on after purchasing them).

Using prior art release tools such as 14, rig workers would attempt to lift and move the combination IBOP/release tool into position over a working drillpipe for attachment using a rig hoist. The problem is that the open archway 19, if present, and/or lateral grab handles 21, are not lifting eyes. They are hard to tie onto. Rig workers formerly would wrap a manipulator (chain, cable, strap, or rope) around the grab handles 21 and pick up the device using the rig hoist, align threads 20 with threads of the working drillpipe, and turn (rotate) the IBOP/release tool using grab handles 21, with or without a chain tongs. The IBOP may weigh from 200 to 300 pounds (91 to 136 kg). Injury to rig workers is of utmost concern. While the "iron" (oilfield term for rig tools) is accustomed to being dropped and banged around the rig, the rig workers have the difficult tasks of not only picking up the IBOP/release tool using the rig hoist, but picking it up straight (vertical or substantially vertical) to align with and screw onto the working drillpipe, which more often than not has fluids and possibly solids escaping out at a high rate. Experience shows that when rig workers are required to make a loop with a chain, cable, strap, or rope around the whole valve (for example around two handles 21) it rarely if ever picks up straight; it is then necessary to attempt to get it straight to get threads 20 started in the drillpipe threads. In the meantime, the valve or other rig components shift position and the valve slips off the chain, with potential to injury rig workers, and without stopping flow from the drillpipe.

Figure 2:
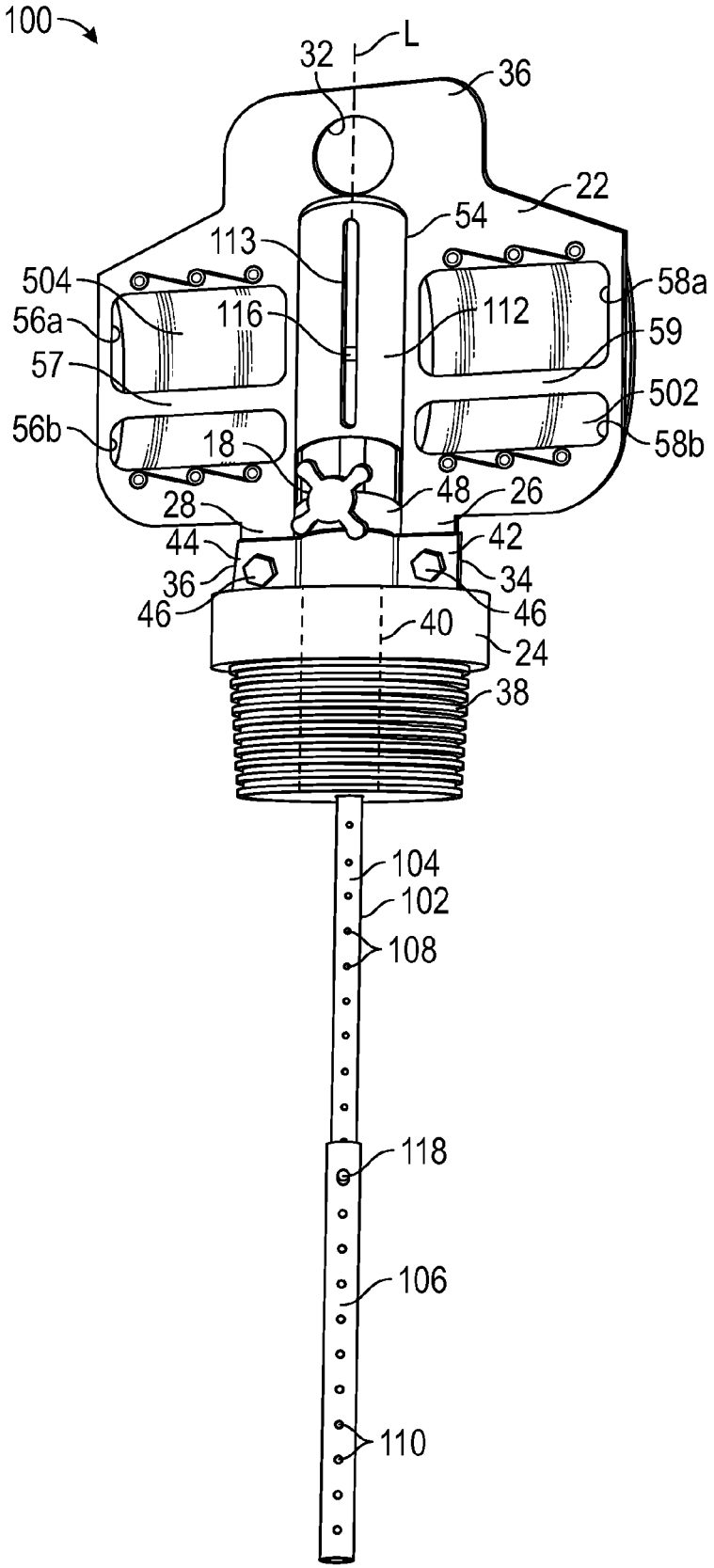
FIG. 2 is a side elevation view of one release tool embodiment within the present disclosure, illustrating the "make-up" side.
Figure 3:
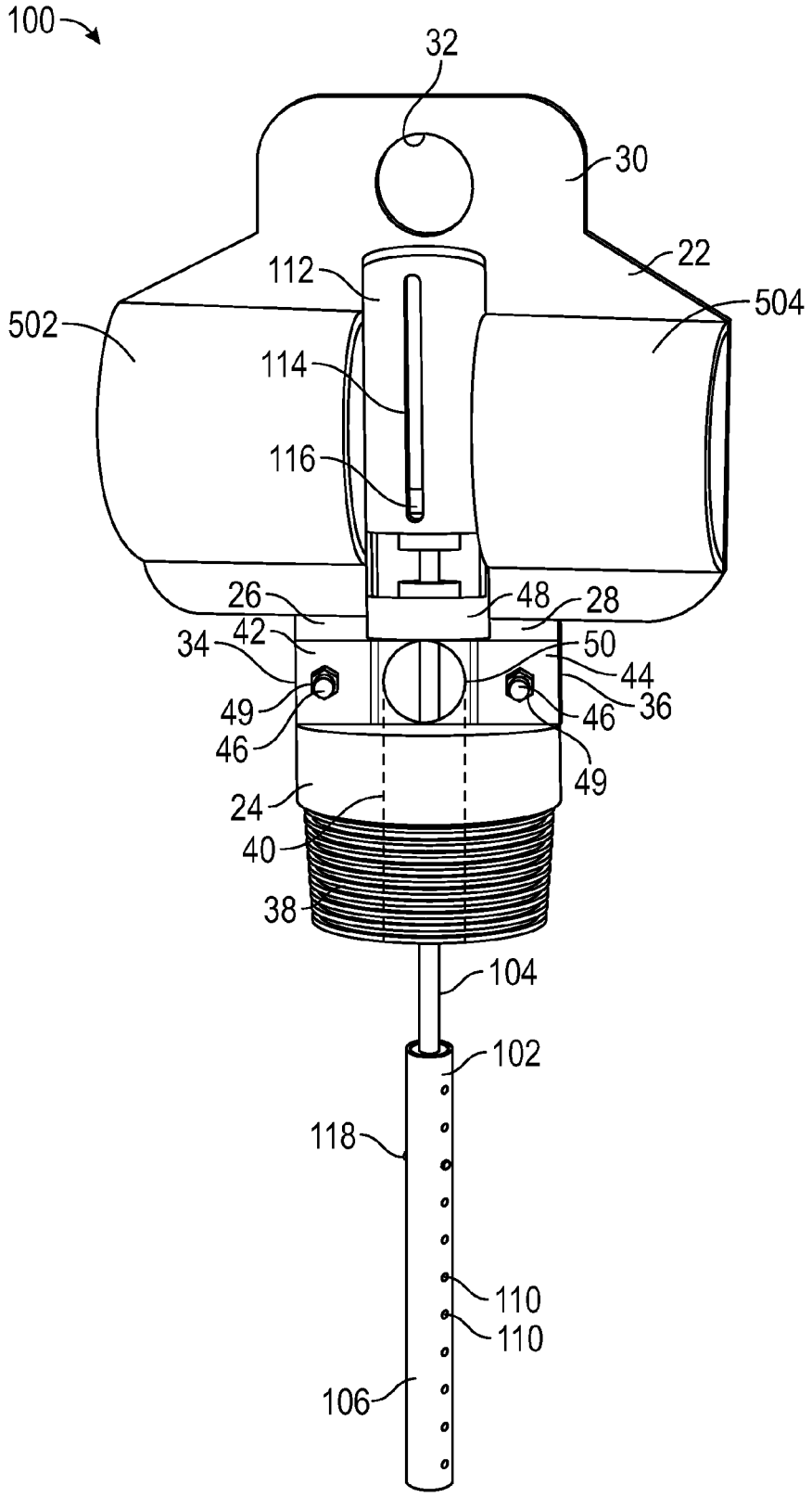
FIG. 3 is a side elevation view of the release tool embodiment of FIG. 2, illustrating the "non-make-up" side.

With these problems in mind, the release tools of the present disclosure were developed. FIG. 2 is a side elevation view of release tool embodiment 100 within the present disclosure, illustrating the "make-up" side, and FIG. 3 is a side elevation view of embodiment 100 of FIG. 2, illustrating the "non-make-up" side. As used herein the term "make-up side" refers to that side of the tool where a worker or machine would grab handles of the devices, as explained herein. Conversely, the term "non-make-up side" as used herein refers to that side opposite of the side of the tool where a worker or machine would grab handles of the devices, and is equivalent to the side of the device where hand-guards or hand-shields are attached. Release tool body 100 includes an upper "flat iron" section 22 having a longitudinal axis "L", and a lower tubular section 24 of same longitudinal axis. Upper section 22 is comprised of two longitudinal members 26, 28, joined by a top manipulating end 30. Upper section 22 is a one-piece, formed, planar, metallic component with no welds, brazing or components welded or brazed thereto. This eliminates the need for pull testing (tensile testing) in offshore applications. Longitudinal members 26, 28 define a central open region 54 there between, each longitudinal member having a lower end 34, 36, respectively, mostly hidden in FIGS. 2 and 3, but viewable in FIGS. 4-6. Top manipulating end 30 includes one or more lifting features 32 formed therein configured to accept one or more manipulator cables or chains (not illustrated), the one or more formed lifting features 32 (lifting eye in FIG. 2) positioned such that when the release tool body 100 and an inside blowout preventer connected thereto (such as depicted schematically in FIG. 4) are lifted by the rig hoist using cables, chains, and like manipulators, they are easily moved over, aligned with, and connected with a working drillpipe while minimizing possibility of slipping off the cables or chains. Severe injury to rig workers is thereby avoided, or at least the possibility greatly reduced, compared with previous designs.

Figure 7:
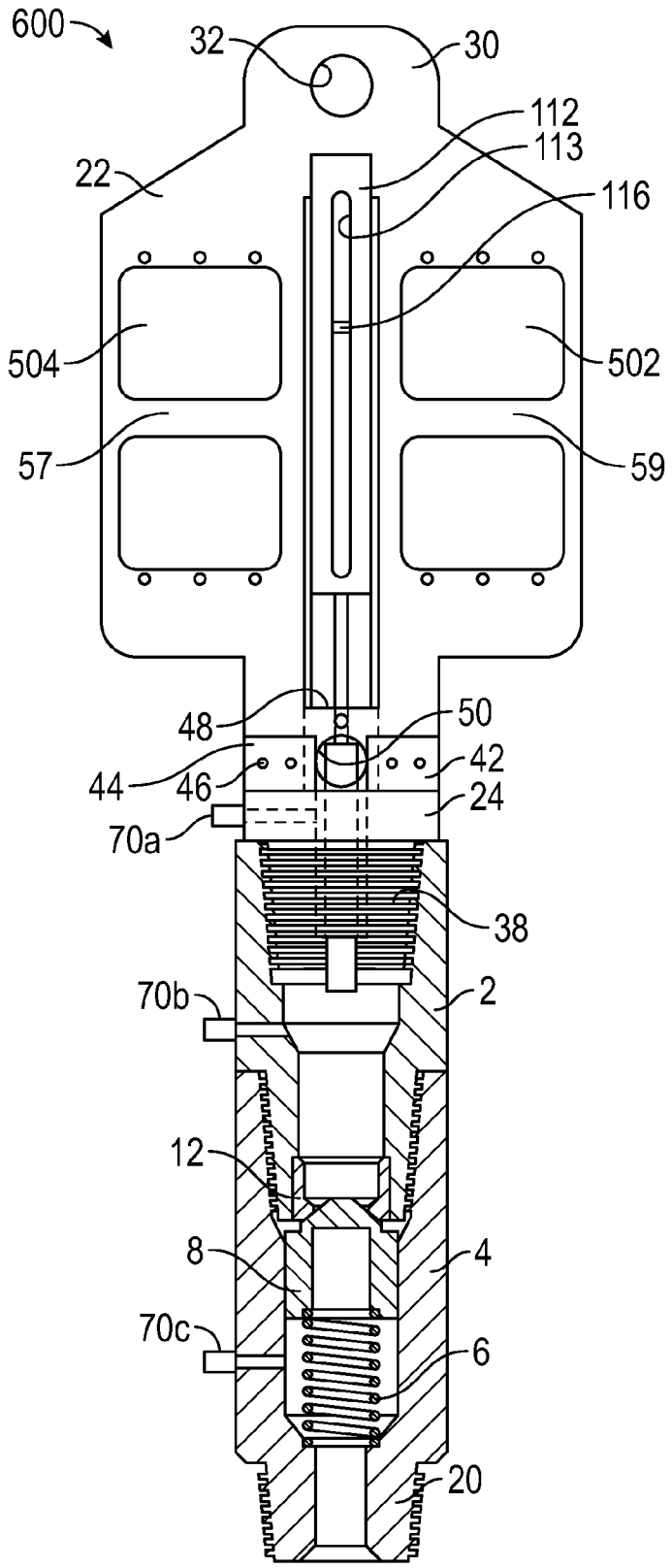
FIG. 7 is a schematic side elevation view, partly in cross-section, of a combination inside blowout preventer and release tool within the present disclosure.

Still referring to FIG. 2, upper section 22 includes, in embodiment 100, formed slots 56*a*, 56*b*, 58*a*, and 58*b*, in this embodiment formed into and through longitudinal members 28, 26, respectively. Formed slots 56*a*, 56*b*, 58*a*, and 58*b* serve to form generally horizontal handles 57, 59 for turning release tool 100 and IBOP attached thereto, (assembled as illustrated in FIG. 7) when positioned and aligned with a working drillpipe. It will be appreciated that more or less (or other shaped) slots or handles, may be provided in each longitudinal member 26, 28. It is not necessary that slots 56*a*, 56*b*, 58*a*, and 58*b* be the same length or shape; however, in order to provide the best weight balance, and therefore best ease of positioning and making up to the drillpipe, it is preferred that longitudinal member 26 be a substantial mirror image of longitudinal member 28, with slots 56*a* and 58*a* of substantially equal dimensions and shape, likewise for slots 58*a* and 58*b*, and handles 57, 59.

Again referring to FIG. 2, lower section 24 includes a threaded end 38, illustrated in FIG. 2 as a pin end, having a central bore 40 illustrated in phantom. Central bore 40 continues up through a lower portion of an axial extension 48, with central bore 40 having a diameter substantially equal to a generally perpendicular fluid outlet port 50 on the non-make-up side (FIG. 3) in axial extension 48. Central bore 40 and outlet port 50 fluidly cooperate to direct flow of fluids and other matter out of release tool 100 while it and the IBOP to which it is attached are being secured to the working drillpipe. Outlet port 50 may be a bore substantially perpendicular to longitudinal axis L, but that is not strictly required. More than one outlet port may be provided as well. Axial extension 48 also includes a central bore having a diameter slightly larger than a length-adjustable release rod 102, the release rod having an upper rod portion 104 in sliding engagement with the central bore. Length-adjustable release rod 102 further includes a lower rod portion 106 having an internal diameter slightly larger than the external diameter of upper rod portion 104, allowing telescopic sliding engagement of upper and lower rod portions 104, 106. Upper rod portion 104 and lower rod portion 106 each include a plurality of through holes 108, 110 allowing length adjustment using one or more cotter pins 118. In certain embodiments, cotter pins could be replaced by or be used in combination with one or more screws, nuts and bolts, and the like. Embodiments may include a rod lock housing 112 including one or more view slots 113, 114 allowing viewing of position of the release rod in housing 112. A quick-release one-piece clamp-on shaft collar 116 may be included, for example, aluminum with black anodized body, with white or other bright color top for ease of viewing position of the release rod. Length-adjustable release rod upper rod portion 104 and lower rod portion 106 may be the same or difference materials of construction, typically, although not necessarily, metal, more preferably steel, aluminum, or brass. These materials may also be used for rod lock housing 112 and fasteners used to hold upper and lower rod portions 104, 106 in relative position.

Figure 5:
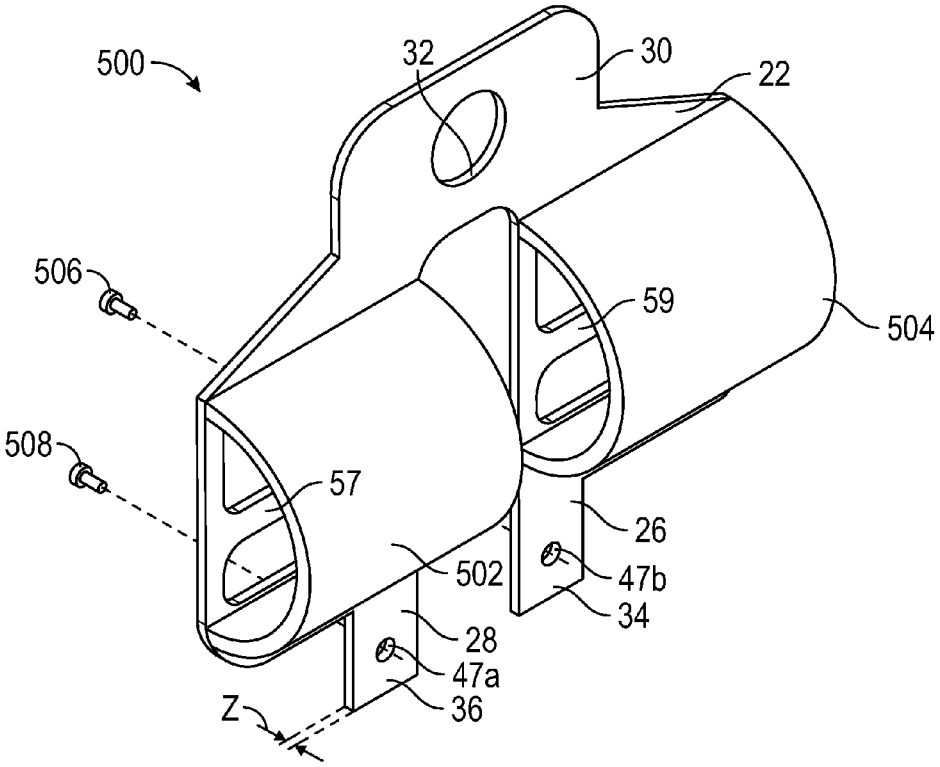
FIG. 5 is a perspective view of the upper section of the release tool of FIGS. 2-3, illustrating the non-make-up side.

The construction details of lower section 24 are discussed in detail in my U.S. Pat. No. 9,404,341, issued Aug. 2, 2016. Lower section 24 includes a pair of formed receptacles 42, 44. Formed receptacles 42, 44 serve to accept and retain lower ends 34, 36 of longitudinal members 26, 28, in conjunction with retaining bolts 46, which may be screws, pins or other components inserted through passages in each receptacle 42, 44. As noted in my previous patent application, it should be noted that in alternative embodiments considered within the present disclosure, ends 34, 36 could be formed to form a female connection to fit onto male members 42, 44, respectively. Since torque is effected on upper section 22 when making up to a working drillpipe, the embodiment illustrated in FIGS. 2 and 3 may be preferred as being somewhat stronger. Female receptacles 42, 44 are formed out of bottom section 24 so that no welding, brazing, or other heat-formed attachment is involved. Further illustrated in FIGS. 2 and 3 are hand guards 502 and 504, held onto upper section 22 using bolts 506, 508 (FIG. 5).

In practice, upper section 22 with lifting eye 32 is interchangeable with all lower sections 24 so that a relatively small batch of upper sections 22 could be made and distributed, whereby a user (rig owner and rig workers) could fit a single upper section 22 on multiple lower sections 24 to fit corresponding sizes (nominal diameters) of IBOP, in turn corresponding to a variety of diameters of working drill pipe as a well is drill or otherwise worked. While not strictly necessary, the hand holds formed in longitudinal members 26, 28 and slots 56*a*, 56*b*, 58*a*, and 58*b* are preferably flat (planar). For subsea use they maybe painted or otherwise colored or made reflective for ease of recognition. Structurally, the new release tool bodies of the present disclosure may support a weight of 3000 pounds (1360 kg) or more when made of 4140HT steel, or equivalent material.

An important feature of the apparatus and methods disclosed herein is the modularity, that is, the lower and upper sections 22, 24 of the release tool body may quickly and easily be disassembled, and the same upper section 22 joined and used with another lower section 24 of same or different outside diameter, for example if the lower section is cracked or otherwise becomes unusable, or if there is a need to change to a different size drillpipe. In certain embodiments, the method comprises determining whether lower section 24 will make up to the IBOP, which depends on whether the IBOP will make up to the working drillpipe, and if not, changing the lower section 24 of the release tool body 100 (FIG. 2) to match size (outside diameter) of another IBOP.

Figure 4:
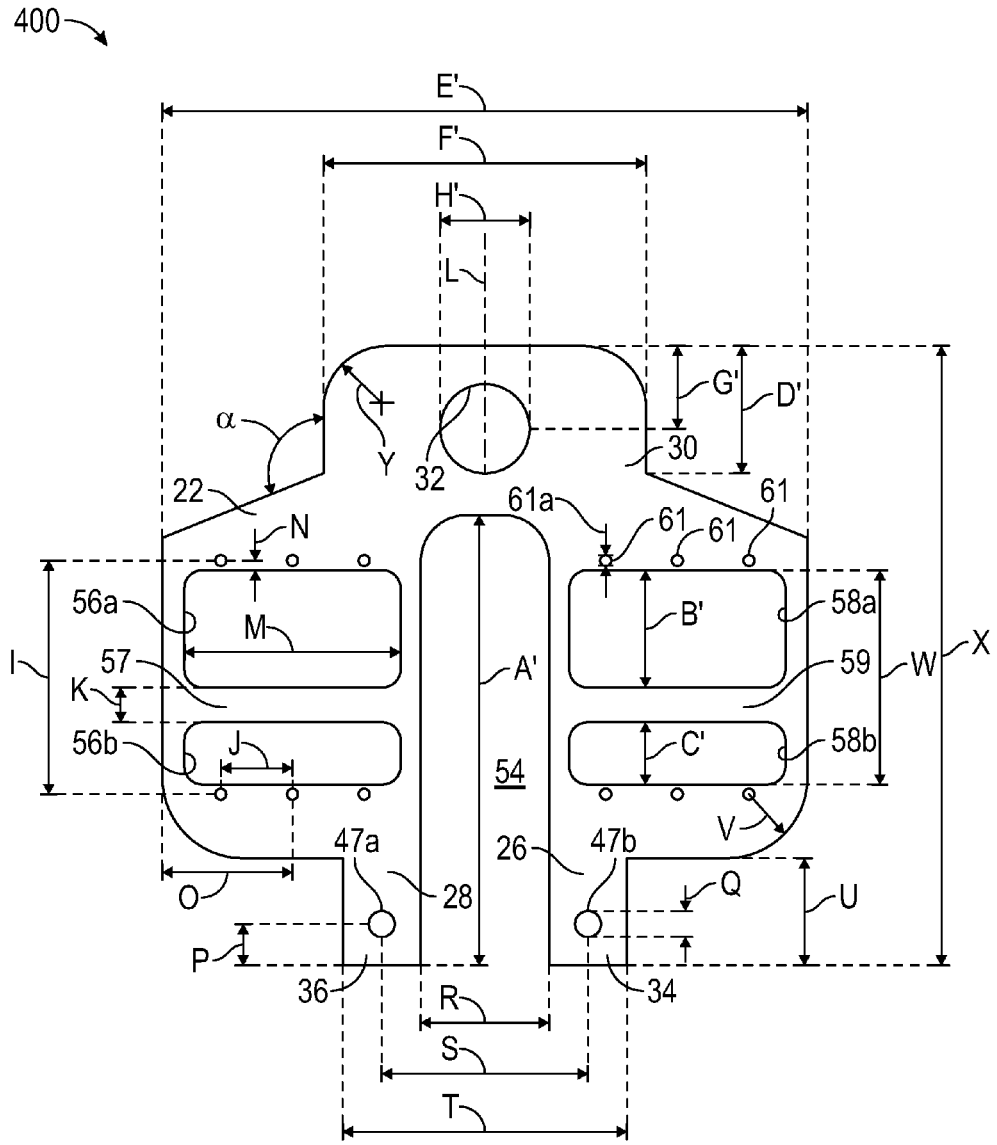
FIG. 4 is a side elevation view of the make-up side of the upper section of the release tool of FIGS. 2-3.
Figure 6:
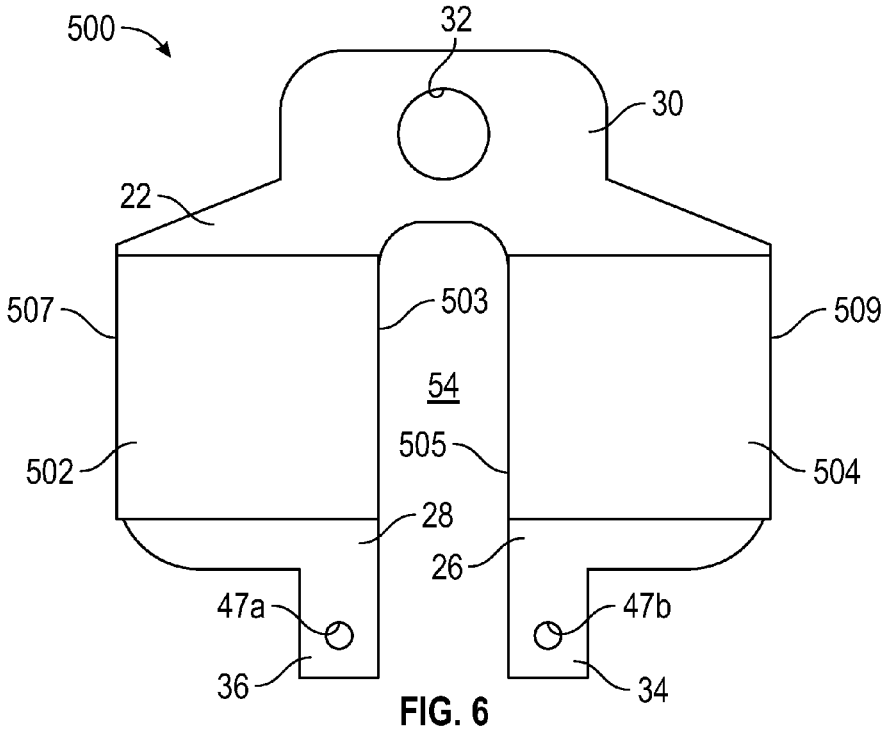
FIG. 6 is a side elevation view of the non-make-up side of the upper section of the release tool of FIGS. 2-3.

FIG. 4 illustrates schematically another embodiment 400 of upper section 22, illustrating formed slots 56*a*, 56*b*, 58*a*, and 58*b*, defining generally horizontal hand holds 57, 59. Also provided are a series of formed through holes 61 (12 total illustrated in embodiment 400, although this number could vary up or down) allowing a pair of hand guards 502, 504 (FIGS. 5, 6) to be attached using threaded bolts 506, 508 (FIG. 5). A pair of through holes 47*a*, 47*b* are provided for attachment of embodiment 400 to lower section 24 (not illustrated in FIGS. 4-6). The dimensions of lengths, angles, and radii illustrated in FIGS. 4-6 are typical and not meant to be limiting in any way. Length dimensions to be noted are designated by the following designations: A', B', C', D', E', F', G', H, I, J, K, M, N, O, P, Q, R, S, T, U, V, W, X, Y, and Z, where Z is the thickness of the entire embodiment 400, which is preferably 0.5 inch, but could be thicker or slightly thinner, depending on the strength requirements. Furthermore, although the preferred metal for embodiment 400 is aluminum, other metals and/or metal alloys could be used. Aluminum is preferred for its low weight, although billet aluminum may be preferred for its strength and may weigh more than cast aluminum. Angle "a" is noted in embodiment 400 to be 112.5 degrees, but angle α could vary from 90 to about 135 degrees. Furthermore, the diameter of attachment holes 61 is noted in embodiment 400 to be 0.25 inch (at 61*a*), but this dimension may vary, as may the number of such attachment holes.

Still referring to FIG. 4 and embodiment 400, the various dimensions and their ranges may be as listed in Table 1, acknowledging that dimensions outside of these ranges may be acceptable:

TABLE 1

Dimensions of Embodiment 400

| Dimension | Embodiment 400 (inch) | Preferred Range (inch) |
|---|---|---|
| A' | 10.551 | 5-25 |
| B' | 2.724 | 1-10 |
| C' | 1.500 | 0.5-5 |
| D' | 3.000 | 1-10 |
| E' | 15.000 | 10-30 |
| F' | 7.500 | 5-15 |
| G' | 1.899 | 1-5 |
| H | 2.100 | 1-5 |
| I | 5.500 | 2-10 |
| J | 1.685 | 1-3 |
| K | 0.776 | 0.5-2 |
| M | 5.055 | 2-10 |
| N | 0.250 | 0.125-2 |
| O | 3.028 | 1-5 |
| P | 1.000 | 0.25-3 |
| Q | 0.625 | 0.25-3 |
| R | 2.89 | 1-5 |
| S | 4.716 | 2-10 |
| T | 6.500 | 3-15 |
| U | 2.500 | 1-10 |
| V | 2.000 | 1-5 |
| W | 5.000 | 3-20 |
| X | 14.50 | 7-40 |
| Y | 1.500 | 0.5-5 |
| Z | 0.500 | 0.3-3 |
| 61a | 0.250 | 0.125-2 |

FIGS. 5 and 6 illustrate schematic perspective and side elevation views, respectively, of embodiment 500 of upper section 22 of embodiment 400 having two hand guards 502, 504 attached thereto using bolts 506, 508. In embodiment 500, there would be six bolts 506, and six bolts 508, corresponding to the twelve through holes 61 illustrated in FIG. 4. It will be understood that a similar arrangement would be provided for attaching hand guard 504, the bolts not being illustrated for clarity. Hand guards 502, 504, are preferably formed from 0.5-inch aluminum pipe that is split in half and milled to provide threaded holes for receiving bolts 506, 508. Embodiment 500 and equivalents thereof provide a lightweight upper section 22, while providing added protection to workers hands. In other embodiments, one hand guard, say 502 for example, may be attached to the opposite side of upper section 22, so that one hand guard is on each side of upper section 22. In yet other embodiments, hand guards 502, 504 need not be round or cylindrical in shape, but could for example be box-shaped, elliptical, triangular, pyramidal, and the like. The side elevation view of FIG. 6 illustrates a preferred arrangement of hand guards 502, 504, in that their inside edges 503, 505 are substantially co-extensive with edges of central open region 54, and their outer edges 507, 509 are substantially co-extensive with respective outer edges of the upper section 22, but this arrangement is not strictly necessary in all embodiments. For example, one or more edges 503, 505, 507, 509 could be rounded inward to allow easier access to hand holds 57, 59 (FIG. 5), or rounded outward to provide even more hand protection.

The valve in the IBOP, whether a flap valve or dart valve, must stay open at all times during picking up, alignment, and threading onto the working drillpipe. In typical practice, one of the rig workers measures the length of release rod 102 required that will ensure the release rod will compress spring 6 under dart 8 holding the valve open. One of the rig workers will then tighten the rod lock screw, then the valve is locked open until the rod lock screw is loosened. Once loosened, spring 6 under dart 8 will expand and slam the valve closed. The release rod 102 will not come completely out of the release tool upper section 22 unless a rig worker unscrews release tool body lower section 24 from upper sub 2 of the IBOP. The IBOP valve must be open in case of an emergency so that rig workers can pick up the complete combination IBOP and release tool using the rig hoist and screw the lower sub threads 20 into the working drillpipe. Drilling fluid, drilling mud, production fluid, and perhaps hydrocarbons and solids may be blowing out the side outlet port 50 while the rig workers are screwing the combination IBOP/release tool into the working drillpipe. Once they have the combination in place they release the rod lock screw 18 and let the valve close and stop the flow of fluid.

FIG. 7 is a schematic side elevation view, partly in cross-section, of a combination inside blowout preventer and release tool 200 within the present disclosure. Quickly aligning and threadably attaching an IBOP to a working drillpipe in the event of a blowout or impending blowout is recognized in the art. What has not been recognized or realized is an apparatus and method to accomplish this without significant risk of the apparatus slipping off lifting devices. As explained previously, external frames have been designed, some with lifting eyes, for effecting alignment, but these add cost and complexity to the procedure, or if available are not necessarily used or favored by rig personnel. Or the prior art simply states that alignment and connection is conveniently done without such external frames, using welded-on handles. The present inventor, however, knows such is not always the case, and knows of multiple accidents that have injured rig workers.

Lower section 24 is illustrated as threaded into upper sub 2 of a prior art IBOP, such as previously disclosed in relation to FIG. 1, or some other prior art IBOP. One or more subs 70*a*, 70*b*, and/or 70*c* may optionally be supplied, especially for subsea use. For example, one or more subs 70*a*, 70*b*, 70*c* may connect to a hydrate inhibition chemical supply line, and when circulating the chemical, it may return to a surface vessel through a return line via a second sub. One or more subs 70*a*, 70*b*, 70*c* may connect a surface chemical supply to subsea choke and kill valves via choke and/or kill lines. One or more of subs 70*a*, 70*b*, 70*c* may be hot stab connections, such as API 17H standard hot stabs, or a pressure gauge, or facilities to allow other kill line parameters to be measured, for example, temperature, viscosity, and the like.

My previous U.S. Pat. No. 9,404,341, issued Aug. 2, 2016, describes a shaft collar useful in certain embodiments. The shaft collar provides a "lock on" item to release rod 102 so users can tell if the valve of the IBOP is open or closed. A rig hand or other worker would press down on top of release rod 102, forcing dart 8 down and compressing spring 6, forcing open the valve, then turn release rod lock screw 18 (shown in FIG. 2) to lock the IBOP valve open. A worker then will slide on a shaft collar and move it all the way down next to top of central axial extension 48, clamping and locking shaft collar closed. Workers or other sensor may then visually see or otherwise detect that when shaft collar rises or is at its upper-most position in housing 112, the IBOP valve is closed. If the shaft collar is down all the way to central axial extension 48, the IBOP valve is open. In certain embodiments, the shaft collar may be a quick-release one-piece clamp-on shaft collar having a body and a clamp lever attached thereto by a pin or other attachment. Quick-release one-piece clamp-on shaft collars are commercially available from McMaster-Carr Supply Company, Chicago, under trade designation 1511K13.

In certain embodiments, an optional rod cap 80 may be placed on the top of release rod 102 to make it easier to push down. These are also described in my previous U.S. Pat. No. 9,404,341, issued Aug. 2, 2016, and are commercially available from McMaster-Carr Supply Company, Chicago, under trade designation 6121K51.

Figure 8:
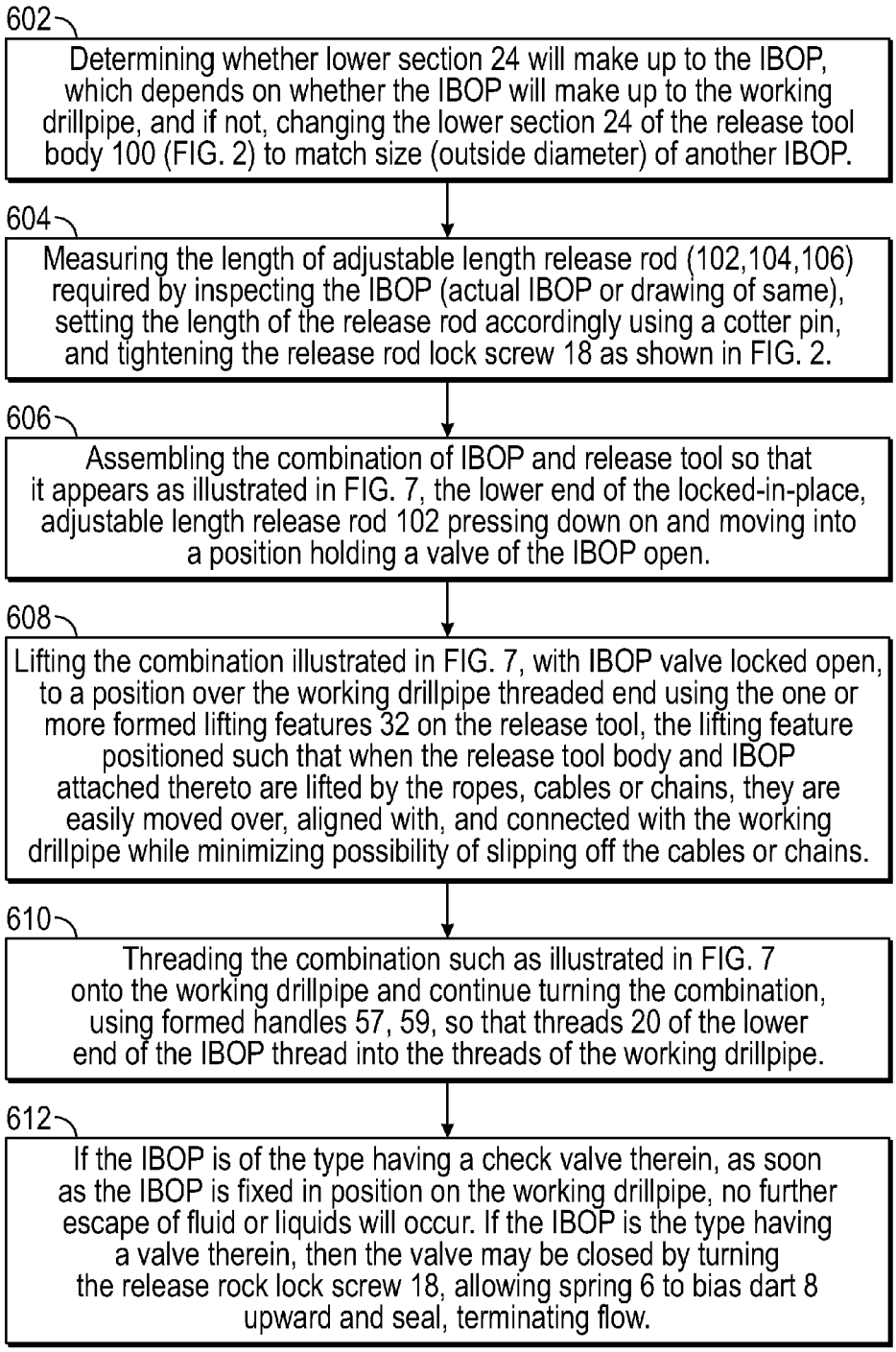
FIG. 8 is a logic diagram of a method of installing the combination of FIG. 7 onto a working drillpipe.

FIG. 8 is a logic diagram of one method of easily and safely attaching a combination inside blowout preventer and release tool having a lower threaded end to a threaded end of a working drillpipe. In certain embodiments, the method first comprises determining whether lower section 24 will make up to the IBOP, which depends on whether the IBOP will make up to the working drillpipe, and if not, changing the lower section 24 of the release tool body 100 (FIG. 2) to match size (outside diameter) of another IBOP (box 602). The method further comprises measuring the length of adjustable length release rod (102, 104, 106) required by inspecting the IBOP (actual IBOP or drawing of same), setting the length of the release rod accordingly using a cotter pin, and tightening the release rod lock screw 18 as shown in FIG. 2 (box 604). The method further comprises assembling the combination of IBOP and release tool so that it appears as illustrated in FIG. 7 (box 304), the lower end of the locked-in-place, adjustable length release rod 102 pressing down on and moving into a position holding a valve of the IBOP open (box 606). The method then comprises lifting the combination illustrated in FIG. 7, with IBOP valve locked open, to a position over the working drillpipe threaded end using the one or more formed lifting features 32 on the release tool, the lifting feature positioned such that when the release tool body and IBOP attached thereto are lifted by the ropes, cables or chains, they are easily moved over, aligned with, and connected with the working drillpipe while minimizing possibility of slipping off the cables or chains (box 608). The method continues with the step of threading the combination such as illustrated in FIG. 7 onto the working drillpipe and continue turning the combination, using formed handles 57, 59, so that threads 20 of the lower end of the IBOP thread into the threads of the working drillpipe (box 610). If the IBOP is of the type having a check valve therein, as soon as the IBOP is fixed in position on the working drillpipe, no further escape of fluid or liquids will occur. If the IBOP is the type having a valve therein, then the valve may be dosed by turning the release rock lock screw 18, allowing spring 6 to bias dart 8 upward and seal, terminating flow (box 612).

Thus the apparatus, combinations, and methods described herein provide a quick and safe way of quickly picking up, aligning, and attaching an IBOP to a working drillpipe without extraneous mechanical frames and with significantly, reduced risk of injury to rig workers.

Certain method embodiments may include using a mobile offshore drilling unit (MODU). Certain method embodiments may comprise disconnecting an umbilical or other flexible conduit using a quick disconnect (QDC) coupling configured as part of one or more subs 70*a*, 70*b*, 70*c* (FIG. 7). Certain subsea method embodiments may include assuring flow of fluid through the IBOP using external wet insulation on at least a portion of the outer IBOP for flow assurance. Certain subsea method embodiments may include assuring flow of fluid through the IBOP using a flow assurance fluid, for example a gas atmosphere in the annulus between the inner and outer body of an insulated IBOP, or hot seawater or other water pumped into the IBOP, or methanol. Certain subsea method embodiments may comprise fluidly connecting a source of hydrate inhibition fluid to the IBOP via one or more subs 70.

Over the past several years, the suitability of using high strength steel materials and specially designed thread and coupled (T&C) connections that are machined directly on the joints at the mill has been investigated. See Shilling et al., "Development Of Fatigue Resistant Heavy Wall Riser Connectors For Deepwater HPHT Dry Tree Risers", OMAE2009-79518. These connections eliminate the need for welding and facilitate the use of materials like C-110 and C-125 metallurgies that are NACE qualified. The high strength may significantly reduce the wall thickness required, enabling an IBOP to be designed to withstand pressures much greater than can be handled by X-80 materials and installed in much greater water depths due to the reduced weight and hence tension requirements. The T&C connections eliminate the need for 3$^{rd}$ party forgings and expensive welding processes—considerably improving apparatus delivery time and overall cost. For onshore use, the release tool and IBOP structural components may be made of 4140HT steel, or equivalent material.

From the foregoing detailed description of specific embodiments, it should be apparent that patentable apparatus, combinations, and methods have been described. Although specific embodiments of the disclosure have been described herein in some detail, this has been done solely for the purposes of describing various features and aspects of the apparatus, combinations, and methods, and is not intended to be limiting with respect to their scope. It is contemplated that various substitutions, alterations, and/or modifications, including but not limited to those implementation variations which may have been suggested herein, may be made to the described embodiments without departing from the scope of the appended claims.

What is claimed is:

1. A modular release tool for use with an inside blowout preventer, the modular release tool comprising:

a one-piece, formed, planar metallic upper section having a longitudinal axis, the upper section comprising a pair of longitudinal members defining a central open region, each longitudinal member having a lower end, the longitudinal members joined by a top manipulating end having one or more lifting features formed therein configured to accept one or more manipulator cables or chains, the one or more formed lifting features positioned such that when the release tool body and the inside blowout preventer connected thereto are lifted by the manipulator cables or chains they are they are easily moved over, aligned with, and connected with a working drillpipe, and configured to prevent the manipulators slipping off;

a one-piece, formed, tubular metallic lower section removably attached to the upper section having the same longitudinal axis as the upper section, the lower section comprising a threaded externally tapered pin end configured to threadedly mate with a box end of an inside blowout preventer;

a central longitudinal bore having diameter sufficient to slidingly accept a release rod;

an upper end formed to accept the lower ends of the longitudinal members of the upper section and retaining members therefore;

the upper end further formed to comprise a central axial extension comprising one or more fluid outlets fluidly connected with the central longitudinal bore, the central axial extension of length sufficient to accommodate an internally threaded bore substantially perpendicular to and intersecting the central longitudinal bore, and accept a mating threaded release rod lock screw therein;

one or more formed slots in each longitudinal member of size sufficient to define one or more manipulating handles for a rig worker or mechanical manipulator to grasp the upper section and rotate the release tool and thread the pin end of the lower section into the box end of the inside blowout preventer, and thread the inside blowout preventer into a drillpipe; and a length-adjustable release rod slidingly positioned in the lower section central bore and dimensioned so as to be accessible by a rig worker or remotely operated device through the central region of the upper section, the central region having a width substantially larger than diameter of the release rod.

2. The modular release tool according to claim 1 wherein the length-adjustable release rod comprises an upper and a lower rod portion telescopically engaged and held in length position by one or more fasteners.

3. The modular release tool according to claim 1 further comprising a rod lock housing including one or more view slots allowing viewing of position of the release rod in the housing.

4. The modular release tool according to claim 1 wherein the one or more lifting features is a single centered lifting eye formed through the top manipulating end of the upper section.

5. The modular release tool according to claim 1 wherein the upper end of the lower section is formed to include a pair of vertical receptacles for the lower ends of the upper section, and wherein the retaining members comprise one or more screws threaded through corresponding threaded bores through the receptacles and lower ends.

6. The modular release tool according to claim 1 wherein the central open region is sufficiently large to allow a rig worker or mechanical manipulator to engage a release rod and move the release rod downward, opening a valve in the inside blowout preventer.

7. The modular release tool according to claim 1, further comprising a combination of metallurgy and structural reinforcement to prevent failure of the release tool upon exposure to inner pressure up to 10,000 psia.

8. A combination modular release tool and inside blowout preventer for threadedly attaching to a drillpipe, the drillpipe having a threaded end for engaging the inside blowout preventer, the combination comprising an inside blowout preventer having a lower end threadably engageable with the drillpipe threaded end and an upper box end threadably engaged with the modular release tool of claim 1.

9. The combination of claim 8 wherein the one or more lifting features is a single centered lifting eye formed through the top manipulating end of the upper section.

10. The combination of claim 8 wherein the upper end of the lower section is formed to include a pair of vertical receptacles for the lower ends of the upper section, and wherein the retaining members comprise one or more screws threaded through corresponding threaded bores through the receptacles and lower ends.

11. The combination of claim 8 further comprising one or more subsea hot stab ports for subsea ROV intervention and/or maintenance of the inside blowout preventer.

12. The combination of claim 8 comprising one or more ports allowing pressure and/or temperature monitoring inside the inside blowout preventer.

13. The combination of claim 8 further comprising a combination of metallurgy and structural reinforcement to prevent failure of the inside blowout preventer and/or release tool upon exposure to inner pressure up to 10,000 psia.

14. The combination of claim 8 further comprising one or more subsea umbilicals fluidly connected to locations on the inside BOP selected from the group consisting of a kill line, a choke line, and both kill and choke lines.

15. A modular release tool for use with an inside blowout preventer, the modular release tool comprising:

a one-piece, formed, planar metallic upper section having a longitudinal axis, the upper section comprising a pair of longitudinal members defining a central open region, each longitudinal member having a lower end, the longitudinal members joined by a top manipulating end having one or more lifting features formed therein configured to accept one or more manipulators, the one or more formed lifting features positioned such that when the release tool body and an inside blowout preventer connected thereto are lifted by the one or more manipulator, they are easily moved over, aligned with, and connected with a working drillpipe, and configured to prevent the manipulators slipping off, and two or more formed slots in each longitudinal member of size sufficient to define one or more generally horizontal manipulating handles for a rig worker or mechanical manipulator to grasp the upper section and rotate the release tool and thread the pin end of the lower section into the box end of the inside blowout preventer;

a one-piece, formed, tubular metallic lower section removably attached to the upper section having the same longitudinal axis as the upper section, the lower section comprising a threaded end configured to threadedly mate with an end of an inside blowout preventer;

a central longitudinal bore of diameter sufficient to slidingly accept a release rod;

an upper end formed to accept the lower ends of the longitudinal members of the upper section and retaining members therefore;

the upper end further formed to comprise a central axial extension comprising one or more fluid outlets fluidly connected with the central longitudinal bore, the central axial extension of length sufficient to accommodate an internally threaded bore substantially perpendicular to and intersecting the central longitudinal bore, and accept a mating threaded release rod lock screw therein; and a length-adjustable release rod slidingly positioned in the lower section central bore and dimensioned so as to be accessible by a rig worker or remotely operated device through the central region of the upper section, the central region having a width substantially larger than diameter of the release rod.

16. The modular release tool according to claim 15 wherein the length-adjustable release rod comprises an upper and a lower rod portion telescopically engaged and held in length position by one or more fasteners.

17. The modular release tool according to claim 15 further comprising a rod lock housing including one or more view slots allowing viewing of position of the release rod in the housing.

18. The modular release tool body of claim 15 further comprising hand guards removably attached to each longitudinal member, the hand guards positioned and sized sufficiently to provide protection to a worker's hands or mechanical manipulator when grasping the generally horizontal manipulating handles.

19. The modular release tool body of claim 15 wherein the hand guards are half members of split aluminum pipe attached to the longitudinal members using bolts.

20. A method of easily and safely attaching a combination inside blowout preventer (IBOP) and release tool having a lower threaded end to a threaded end of a working drillpipe, the method comprising the steps of:

(a) optionally, determining whether a lower section of the release tool will make up to the IBOP, which depends on whether a lower end of the IBOP will make up to the working drillpipe, and if not, changing the lower section of the release tool to match size (outside diameter) of another IBOP;

(b) measuring the length of an adjustable length release rod required by inspecting the IBOP (actual IBOP or drawing of same), setting the length of the adjustable length release rod accordingly, and tightening a release rod lock screw;

(c) assembling the combination of IBOP and release tool so that a lower end of the locked-in-place, adjustable length release rod presses down on and moves into a position holding a valve of the IBOP open;

(d) lifting the combination, with IBOP valve locked open, to a position over the working drillpipe threaded end using one or more formed lifting features on the release tool, the lifting feature positioned such that when the combination is lifted by ropes, cables or chains, the combination is easily moved over, aligned with, and connected with the working drillpipe, and configured to prevent the ropes, cables, or chains slipping off;

(e) threading the combination onto the working drillpipe and continue turning the combination using formed handles so that threads of the lower end of the IBOP thread into the threads of the working drillpipe; and (f) optionally, if the IBOP is of the type having a check valve therein, fixing the IBOP in position on the working drillpipe so that no further escape of fluid or liquids will occur, and if the IBOP is the type having a dart valve therein, closing the dart valve by turning the release rod lock screw, allowing an IBOP spring to bias an IBOP dart upward and seal, terminating flow.

* * * * *